US010328328B2

(12) United States Patent
Benkreira et al.

(10) Patent No.: US 10,328,328 B2
(45) Date of Patent: Jun. 25, 2019

(54) GAME TIME-OUTS MANAGEMENT SYSTEM AND METHOD

(71) Applicants: Mohamed Benkreira, Montreal (CA); Rachid Lamdjadani, Longueuil (CA)

(72) Inventors: Mohamed Benkreira, Montreal (CA); Rachid Lamdjadani, Longueuil (CA)

( * ) Notice: Subject to any disclaimer, the term of this patent is extended or adjusted under 35 U.S.C. 154(b) by 278 days.

(21) Appl. No.: 15/521,156

(22) PCT Filed: Oct. 21, 2015

(86) PCT No.: PCT/CA2015/000546

§ 371 (c)(1),
(2) Date: Apr. 21, 2017

(87) PCT Pub. No.: WO2016/061663

PCT Pub. Date: Apr. 28, 2016

(65) Prior Publication Data

US 2019/0091542 A1 Mar. 28, 2019

(30) Foreign Application Priority Data

Oct. 24, 2014 (GB) ..... 1418931.0

(51) Int. Cl.
*A63B 71/06* (2006.01)
*G07C 1/28* (2006.01)
(Continued)

(52) U.S. Cl.
CPC ..... *A63B 71/0616* (2013.01); *A63B 71/0669* (2013.01); *G07C 1/28* (2013.01); *G08B 5/36* (2013.01); *G09G 3/004* (2013.01)

(58) Field of Classification Search
CPC .. A63B 71/0616; A63B 71/0669; G07C 1/28; G08B 5/36; G09G 3/004
See application file for complete search history.

(56) References Cited

U.S. PATENT DOCUMENTS 3,444,548 A 5/1969 Davis
3,638,215 A 1/1972 Payne
(Continued)

FOREIGN PATENT DOCUMENTS

FR 2695042 3/1994
JP 2001051626 2/2001

OTHER PUBLICATIONS

Written Opinion of the International Searching Authority issued by the World Intellectual Property Organization dated Mar. 1, 2016 for PCT application PCT/CA2015/000546 from which the present application claims priority.
(Continued)

*Primary Examiner* — Sisay Yacob

(57) ABSTRACT

A method (300) for managing time-outs in a game, including: putting a receiver unit (14) in a ready state (205); receiving at the receiver unit (14) a desired time-out signal from a transmitter unit (12); putting the receiver unit in a time-out approval state (210, 215) and indicating to the game official through a receiver user interface (62) that the desired time-out signal has been received; receiving from the game official through the receiver user interface (62) one of an allow command and a deny command. When the allow command is received, the time-out counter (78, 80) is incremented, and, when the deny command is received, the receiver unit (14) is returned to the ready state (205) while keeping constant the time-out counter (78, 90).

11 Claims, 6 Drawing Sheets

(51) Int. Cl.
*G09G 3/00* (2006.01)
*G08B 5/36* (2006.01)

(56) References Cited

U.S. PATENT DOCUMENTS 3,651,507 A 3/1972 Abbott
4,045,788 A 8/1977 Castelli et al.
4,541,013 A 9/1985 Alpert
4,647,969 A 3/1987 Graham, Sr.
4,751,506 A 6/1988 Brown
5,065,251 A 11/1991 Shuhart, Jr.
5,293,354 A 3/1994 Costabile
5,898,587 A 4/1999 Bell et al.
6,144,620 A 11/2000 Depoortere
6,181,236 B1 1/2001 Schneider, Jr.
6,369,697 B1 4/2002 Poole
6,593,846 B1 7/2003 Watts
6,603,711 B2 8/2003 Calace
6,816,442 B1 11/2004 Heiman
7,031,225 B2 * 4/2006 McDonald ..... G04F 8/08 340/323 R
7,218,216 B1 * 5/2007 Uehran ..... A63B 71/06 340/517
7,394,348 B2 7/2008 Roeske
8,054,174 B1 * 11/2011 Uehran ..... A63B 71/0605 273/317.3
2003/0058744 A1 3/2003 Calace
2010/0085167 A1 4/2010 Costabile
2011/0032086 A1 2/2011 Cabrera
2012/0002509 A1 1/2012 Saguin et al.
2012/0063272 A1 3/2012 Dorais et al.

OTHER PUBLICATIONS

International Search Report issued by the World Intellectual Property Organization dated Mar. 1, 2016 for PCT application PCT/CA2015/000546 from which the present application claims priority.

* cited by examiner

GAME TIME-OUTS MANAGEMENT SYSTEM AND METHOD

FIELD OF THE INVENTION

The present invention relates generally to game refereeing aids and, more particularly, to a game time-outs management system, and a method of using same.

BACKGROUND

Known game time-outs managing systems are useful for aiding a time-out official who is supervising a game event such as, for example, handball, basketball, water polo or other similar athletic games that allow time-out requests for each teams facing one another in a game.

These known systems generally provide a means for the time-out official to keep a record of statutory time-outs that have been requested and granted to each team during the game and, in some cases, a means to keep track of the elapsing time actively used by a team that has requested a time-out.

Typically, such systems are generally represented by a manual method wherein the time-out official observes the game, as well any one of the two coaches that may come with an official time-out request in the form of a carton or ticket that is deposited on the desk of the official or with hands face to the official, as is customary in internationally recognized handball, basketball, water polo, . . . game tournaments. If the team of the coach presenting the time-out request is in possession of the ball (handball, water polo) or not in possession of the ball (basketball, . . . ), depending on the rules of the sport discipline, the time-out is usually granted by the official. The time-out official may additionally keep track of the time-outs on record paper using a pen, and with the help of a hand chronometer, may signal to the teams the start and end of a granted time-out period.

With the advent of electronic scoreboard systems, such as the typically large game scoreboards mounted high on a pole or a wall of stadiums, arenas and school gyms around the world, more and more information concerning the time outs, such as the time and number of granted time-outs per team, and the likes, are made available to everyone on and around the game court. But essentially, this information is still generally registered manually.

While these known prior art systems and methods can generally fulfill the main objective of aiding a time-out official to keep track of statutory time-out requests granted to each team during an actively played game, they are also generally inefficient in executing this very same task.

For example, conflicts generally arise during an often occurring delay between the exact moment in time a coach asks for a time-out and the exact moment in time a time-out official grants the requested time-out to the coach, during which time the opponent team may take an opportunity to recover the ball and score a goal.

In view of the above, there is a need for an improved game time-outs management system and method.

An object of the present invention is to provide such a system and method.

SUMMARY OF THE INVENTION

In a broad aspect, the invention provides a method for managing time-outs in a game, the method using a transmitter unit usable by a game participant and a receiver unit usable by a game official, the transmitter and receiver units having respectively transmitter and receiver user interfaces, the receiver user interface having a time-out counter, the method comprising: putting the receiver unit in a ready state; with the receiver unit in the ready state, receiving at the receiver unit a desired time-out signal from the transmitter unit, the desired time-out signal indicating that the game participant wishes to take one of the time-outs; putting the receiver unit in a time-out approval state and indicating to the game official through the receiver user interface that the desired time-out signal has been received; receiving from the game official through the receiver user interface one of an allow command and a deny command. The allow and deny commands indicate respectively that the one of the time-outs is allowed or denied, the allow and deny commands being issued by the game official according to predetermined criteria dictated by rules according to which the game is played. When the allow command is received, the time-out counter is incremented, and, when the deny command is received, the receiver unit is returned to the ready state while keeping constant the time-out counter.

The invention may also provide a method further comprising receiving from the game participant through the transmitter user interface a time-out command indicating that the one of the time-outs is desired.

The invention may also provide a method further comprising, in response to the time-out command being received, transmitting from the transmitter unit to the receiver unit the desired time-out signal.

The invention may also provide a method wherein the game has a predetermined duration timed using a game clock, the method further comprising stopping the game clock when the allow command is received and letting the game clock run when the deny command is received.

The invention may also provide a method further comprising issuing a game clock stop signal from the receiver unit; receiving the game clock stop signal at the game clock; and in response to receiving the game clock stop signal, stopping the game clock.

The invention may also provide a method wherein the game clock stop signal is sent automatically by the receiver unit when the allow command is received.

The invention may also provide a method wherein the game clock includes a time-out timer, the method further comprising starting the time-out timer automatically when the game clock stop signal is received.

The invention may also provide a method further comprising with the receiver unit in the time-out approval state, receiving at the receiver unit a cancel time-out signal from the transmitter unit, the cancel time-out signal indicating that the game participant no longer wishes to take the one of the time-outs; indicating to the game official through the receiver user interface that the cancel time-out signal has been received; wherein, when the cancel time-out signal is received before the allow command is received, the receiver unit is returned to the ready state while keeping constant the time-out counter.

The invention may also provide a method wherein the game official uses a video recording system to record the game, the video recording system being operative for playing back part of the game when receiving a playback signal, the method further comprising, in response to receiving the desired time-out signal, issuing the playback signal from the receiver unit to the video recording system so that the game is replayed around a moment at which the desired time-out signal has been received.

The invention may also provide a method wherein the receiver user interface is operative for receiving manual increment and decrement commands from the game official and the receiver unit is operative for increasing by one or decreasing by one the time-out counter in response to receiving respectively the manual increment and decrement commands.

The invention may also provide a method wherein indicating to the game official through the receiver user interface that the desired time-out signal has been received includes turning on a light on the receiver user interface.

The invention may also provide a method wherein indicating to the game official through the receiver user interface that the desired time-out signal has been received includes emitting a desired time-out sound for a predetermined duration.

The invention may also provide a method wherein the rules include time-out rules determining when the one of the time-outs can be allowed, the receiver unit being operative for automatically denying the one of the time-outs and returning the receiver unit to the ready state when at least one of the time-out rules dictates that the one of the time-outs should be denied.

The invention may also provide a method wherein the at least one of the time-out rules dictates a maximal number of time-outs that can be requested during the game, the receiver unit comparing the time-out counter to the maximal number of time-outs when the desired time-out signal is received and automatically denying the time-out when the time-out counter and the maximal number of time-outs are equal.

The invention may also provide a method wherein the game participant is a coach.

The invention may also provide a method wherein the game participant is a game player.

The invention may also provide a method using an other transmitter unit usable by an other game participant, the other transmitter unit having an other transmitter user interface, the receiver user interface having an other time-out counter, the method comprising: with the receiver unit in the ready state, receiving at the receiver unit an other desired time-out signal from the other transmitter unit, the other desired time-out signal indicating that the other game participant wishes to take an other one of the time-outs; putting the receiver unit in an other time-out approval state and indicating to the game official through the receiver user interface that the other desired time-out signal has been received; receiving from the game official through the receiver user interface one of an other allow command and an other deny command, wherein the other allow and deny commands indicate respectively that the other one of the time-outs is allowed or denied, the other allow and deny commands being issued by the game official according to the predetermined criteria. When the other allow command is received, the other time-out counter is incremented, and, when the other deny command is received, the receiver unit is returned to the ready state while keeping constant the other time-out counter.

In another broad aspect, the invention provides a system for managing time-outs in a game in which a game participant requests the time-outs and a game official selectively deny or allow the time-outs depending on predetermined game rules, the system comprising: a transmitter unit usable by the game participant, the transmitter unit including a transmitter user interface and a signal emitter; and a receiver unit usable by the game official, the receiver unit having a receiver user interface and a signal receiver, the receiver user interface having a time-out counter, the receiver unit being movable between a ready state and a time-out approval state. The transmitter unit is operative for receiving from the game participant through the transmitter user interface a time-out command indicating that one of the time-outs is desired and consequently sending a desired time-out signal to the receiver unit with the signal emitter, the desired time-out signal indicating that the game participant wishes to take the one of the time-outs. When in the ready state, the receiver unit is operative for receiving the desired time-out signal at the signal receiver, consequently moving the receiver unit to the time-out approval state and indicating to the game official through the receiver user interface that the desired time-out signal has been received, the receiver unit being further operative, when in the time-out approval state, for receiving from the game official through the receiver user interface one of an allow command and a deny command, the allow and deny commands indicating respectively that the one of the time-outs is allowed or denied, the allow and deny commands being issued by the game official according to predetermined criteria dictated by the predetermined game rules. When the allow command is received, the time-out counter is incremented, and, when the deny command is received, the receiver unit is returned to the ready state while keeping constant the time-out counter.

The invention may also provide a system wherein the game has a predetermined duration, the system further comprising a game clock, the receiver unit being operatively coupled to the game clock for stopping the game clock when the allow command is received and letting the game clock run when the deny command is received.

The invention may also provide a system wherein the game clock includes a time-out timer, the game clock being operative for starting the time-out timer automatically when the game clock is stopped.

The invention may also provide a system wherein the transmitter unit is operative for receiving from the game participant through the transmitter user interface a cancel time-out command indicating that the game participant no longer wishes to take the one of the time-outs and consequently sending a cancel time-out signal to the receiver unit with the signal emitter; and wherein the receiver unit is operative for receiving at the signal receiver the cancel time-out signal, consequently indicating to the game official through the receiver user interface that the cancel time-out signal has been received, and when the cancel time-out signal is received before the allow command is received, returning the receiver unit to the ready state while keeping constant the time-out counter.

The invention may also provide a system further comprising a video recording system usable to record the game, the video recording system being operative for playing back part of the game when receiving a playback signal, the receiver unit being operative for, in response to receiving the desired time-out signal, issuing the playback signal from the receiver unit to the video recording system so that the game can be played back around a moment at which the desired time-out signal has been received.

The invention may also provide a system wherein the receiver user interface is operative for receiving manual increment and decrement commands from the game official and the receiver unit is operative for increasing by one or decreasing by one the time-out counter in response to receiving respectively the manual increment and decrement commands.

The invention may also provide a system wherein the receiver user interface includes a visual indicator that is activated when the receiver unit is moved to the time-out approval state.

The invention may also provide a system wherein the receiver user interface includes a sound indicator that is activated when the receiver unit is moved to the time-out approval state.

The invention may also provide a system wherein the predetermined game rules include time-out rules determining when the one of the time-outs can be allowed, the receiver unit being operative for automatically denying the one of the time-outs and returning the receiver unit to the ready state when at least one of the time-out rules dictates that the one of the time-outs should be denied.

The invention may also provide a system wherein the at least one of the time-out rules dictates a maximal number of time-outs that can be requested during the game, the receiver unit being operative for comparing the time-out counter to the maximal number of time-outs when the desired time-out signal is received and automatically denying the time-out when the time-out counter and the maximal number of time-outs are equal.

The invention may also provide a system wherein an other game participant also requests the time-outs, the system further comprising an other transmitter unit usable by the other game participant, the other transmitter unit including an other transmitter user interface and an other signal emitter, wherein the receiver user interface has an other time-out counter, the receiver unit being also movable to an other time-out approval state; the other transmitter unit is operative for receiving from the other game participant through the other transmitter user interface an other time-out command indicating that an other one of the time-outs is desired and consequently sending an other desired time-out signal to the receiver unit with the other signal emitter, the other desired time-out signal indicating that the other game participant wishes to take the other one of the time-outs; wherein, when in the ready state, the receiver unit is operative for receiving the other desired time-out signal at the signal receiver, consequently moving the receiver unit to the other time-out approval state and indicating to the game official through the receiver user interface that the other desired time-out signal has been received, the receiver unit being further operative, when in the other time-out approval state, for receiving from the game official through the receiver user interface one of an other allow command and an other deny command, the other allow and deny commands indicating respectively that the other one of the time-outs is allowed or denied, the other allow and deny commands being issued by the game official according to the predetermined criteria; and wherein, when the other allow command is received, the other time-out counter is incremented, and, when the other deny command is received, the receiver unit is returned to the ready state while keeping constant the other time-out counter.

Advantageously, the proposed invention allows to easily signal to the game official that a time-out is requested and allows the game official to easily manage allowance or denial of the time-out.

The present application claims benefit from UK request application 1418931.0 filed Oct. 24, 2014, the contents of which is hereby incorporated by reference in its entirety.

Other objects, advantages and features of the present invention will become more apparent upon reading of the following non-restrictive description of some embodiments thereof, given by way of example only with reference to the accompanying drawings.

DETAILED DESCRIPTION

Figure 1:
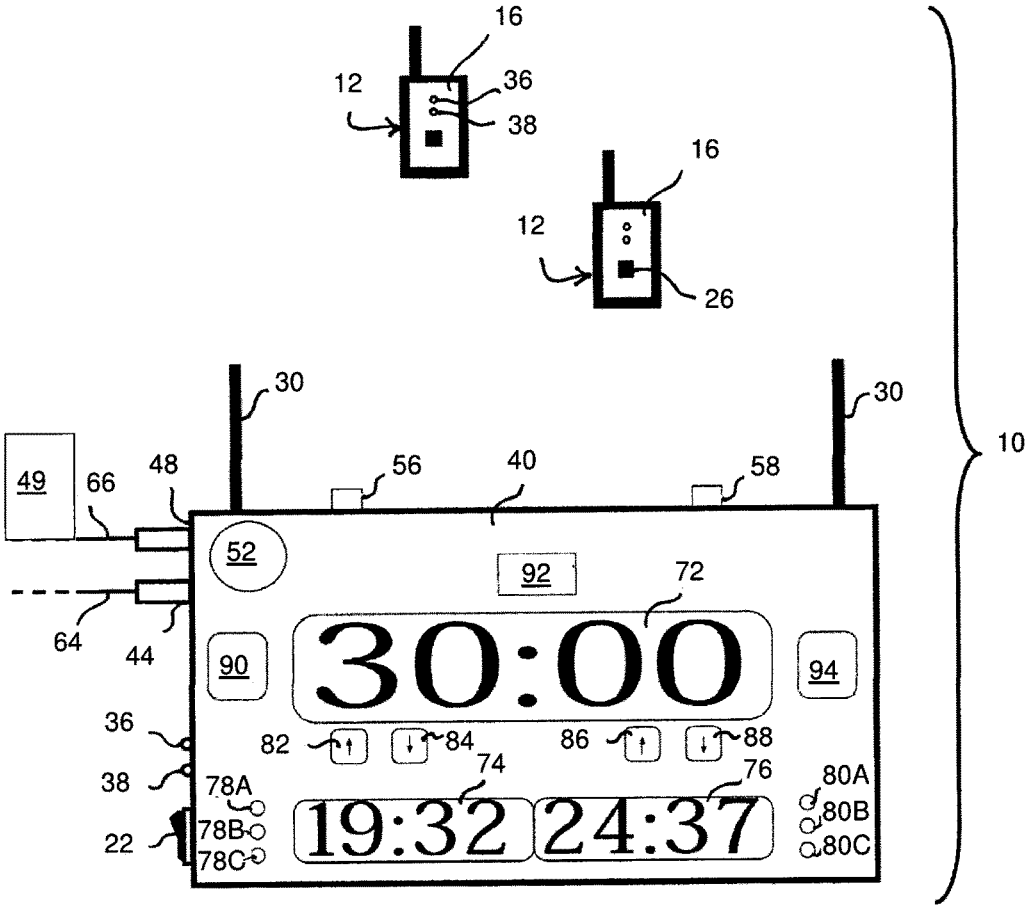
FIG. 1, in a front plan view, illustrates an embodiment of a game time-outs management system, according to the present invention.
Figure 2:
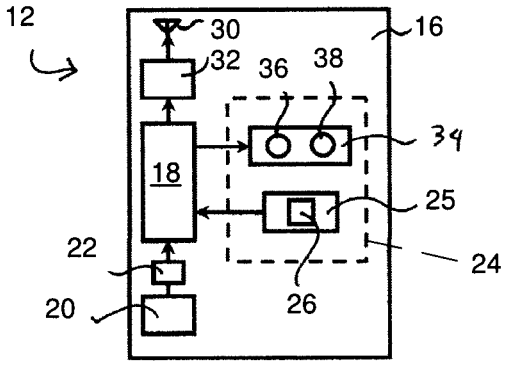
FIG. 2, in schematic representation, illustrates a transmitter unit part of the system of FIG. 1.
Figure 3:
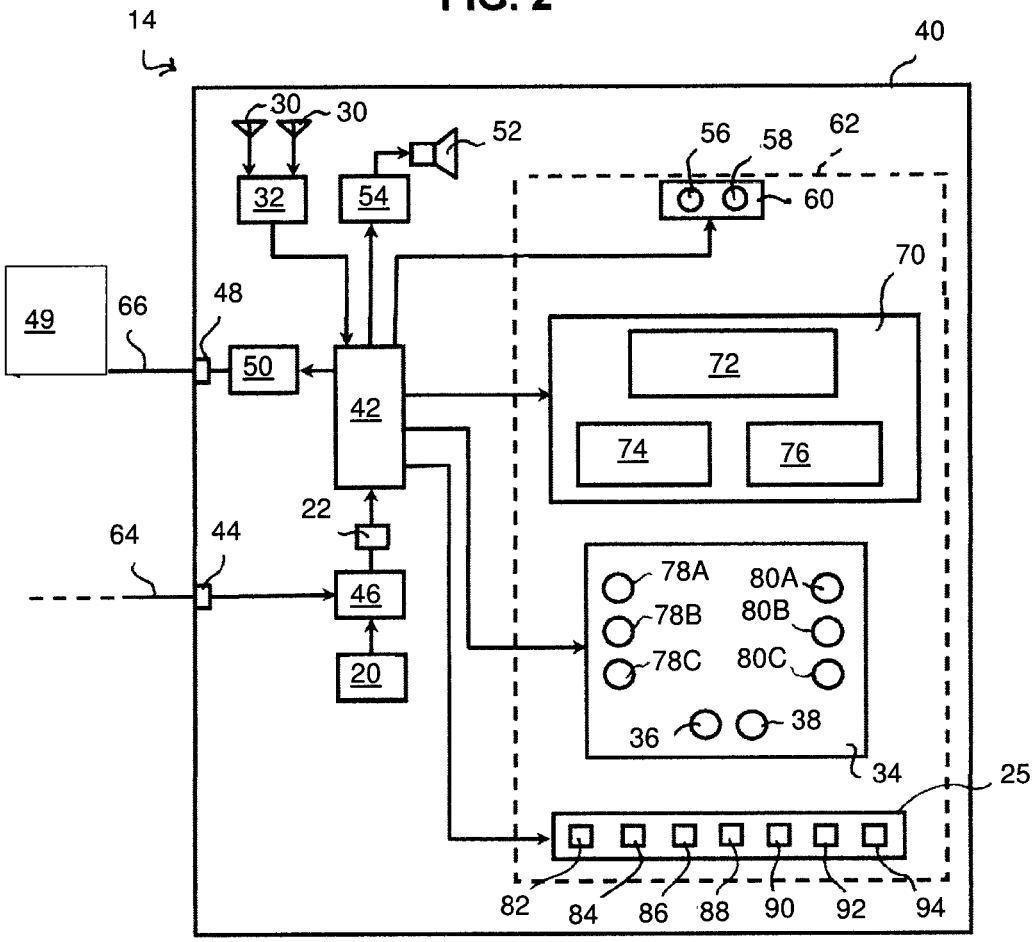
FIG. 3, in schematic representation, illustrates a receiver unit part of the system of FIG. 1.

FIGS. 1 to 3 illustrate various aspects of an embodiment, according to the present invention, of a game time-outs management system 10, hereinafter referenced more simply as the system 10.

The system 10 is usable for managing time-out requests issued by game participants during an actively played game between two teams. The game participant may be a coach of one of the teams, a game player from one of the teams, or in the case of large teams, such as in the case of American football, an assistant to the coach or other support staff from one of the teams.

For exemplary purposes only, the present invention will be described as it is used during a game of handball. It is to be understood that the present invention is usable with any game between two teams in which the statutory game rules allow time-out requests that may be issued by the coach of each one of the teams involved. The statutory game rules include time-out rules determining when the time-outs can be allowed, including for example, and non-limitingly, the moments when time-outs are allowed, previous number of time-outs previously requested, and the phase of play, such as which team has possession of a ball, among others.

As illustrated in FIG. 1, the system 10 comprises two transmitter units 12 and one receiver unit 14. However, in alternative embodiments, only one transmitter unit 12 is used with one receiver unit 14. In that case, it is useful to have two pairs of such systems so that each receiver unit 14 is paired with one of the transmitter units 14 to manage time-out requests for a respective team.

Each transmitter unit 12 is for example represented by a relatively small and battery operated hand-held device in the possession of the coach of each team actively involved in a game. The receiver unit 14 is also for example represented by a portable device that can be alternatively powered by an on-board battery or a standard 120/240 VAC outlet using a suitable AC\DC adapter. Typically, the receiver unit 14 is resting on a table or desk in front of a game official or delegate supervising the time-out requests and positioned on a side of the game court where a game between two teams is to be monitored.

Now referring to FIGS. 1 and 2, each transmitter unit 12 comprises a transmitter housing 16 in which is mounted an electronic circuit. Now referring more particularly to FIG. 2, in a specific embodiment of the invention, the electronic circuit includes a signal transmitter, for example a transmitter microprocessor 18 operatively coupled to an internal battery 20 through a manual power switch 22, a transmitter user interface 24, and a radio-frequency (RF) antenna 30 operated through an antenna driver circuit 32, which together form a signal emitter.

As would be obvious to someone familiar with portable electronic devices, the transmitter microprocessor 18 is for example one of the latest generations of low power programmable microprocessor, micro-controller unit (MCU) or an equivalent instruction processing means that is provided with suitable processing power, memory and inputs/outputs (I/O's). However, in alternative embodiments, the transmitter unit 12 perform its functions in any other suitable manner, for example by including suitable analog electronic components, digital logic gates, and Field Programmable Gate Arrays (FPGAs), for example.

The transmitter microprocessor 18, or an appended memory element thereof, is where is stored program element implementing a transmitter method of operation to be executed by the transmitter microprocessor 18. Typically, the program element is stored at least in a non-transitory memory element, such as a flash memory element, and may also be copied to a transitory memory element, such as a Random Access Memory (RAM) chip. The transmitter method of operation will be described further below. The transmitter microprocessor 18 is operatively coupled to the transmitter user interface 24 for receiving from the game participant through the transmitter user interface 24 a time-out command indicating that the one of the time-outs is desired. Such a command corresponds for example to the game participant depressing a time-out request button 26 part of the transmitter user interface 24. In response to the time-out command being received, the transmitter microprocessor 18 activates the antenna driver circuit 32 for transmitting from the transmitter unit 12 to the receiver unit 14 the desired time-out signal.

The internal battery 20 and manual power switch 22 are for selectively powering On and Off the transmitter unit 12. The internal battery 20 may be a replaceable battery or a permanent rechargeable battery that can be recharged using a suitable micro-USB power adapter or AC power adapter.

The transmitter user interface 24 includes a push button driver circuit 25 operatively coupled to a time-out request button 26 for allowing the coach to selectively operate the transmitter unit 12 so as to transmit at least one desired time-out signal to the receiver unit 14. The time-out request button 26 is for example a momentary push button type switch or equivalent. The push button driver circuit 25 is operatively coupled to the transmitter microprocessor 18 for signaling to the latter when the time-out request button 26 is depressed.

In some embodiments, the transmitter user interface 24 may further include a visual indicator driver circuit 34 operatively coupled to a communication status indicator 36 and a battery status indicator 38. The visual indicator driver circuit 34 is operatively coupled to the transmitter microprocessor 18 for allowing the latter to control the turning on or off of a communication status indicator 36 and a battery status indicator 38, which are for respectively indicating to the coach that a desired time-out signal is actively transmitted to the receiver unit 14, and that the battery has sufficient, or alternatively, insufficient power to properly operate the transmitter unit 12. Each of the communication status indicator 36 and battery status indicator 38 may be represented by a L.E.D. (Light Emitting Diode). Other types of equivalent visual indicators are also possible.

The radio-frequency (RF) antenna 30 and antenna driver circuit 32 cooperatively transmit wirelessly the desired time-out signal generated by the transmitter microprocessor 18 to the receiver unit 14. The transmitter microprocessor 18 is operatively coupled to the antenna driver circuit 32 for transmitting there to the desired time-out signal. It should be noted that in alternative embodiments, the transmitter and receiver units 12 and 14 communicate in any other suitable manner, such as, for example and non-limitingly, through a cabled connection, through optical means, either in optical waveguides or through air, through ultrasounds or through a wired or wireless network, among other possibilities.

As would be obvious to someone familiar with embedded programming in portable devices provided with user interface buttons and indicators, the transmitter method of operation may be generally represented by a conventional loop-type set of software program instructions.

For example, the transmitter method of operation may comprises, in a first step, initializing the transmitter unit 12 on power up of the latter, in a second step, detecting a rising edge in an electrical signal at the transmitter microprocessor upon activation of the time-out request button 26, and in a third step, wirelessly transmitting to the receiver unit 14 a suitable time-out request signal, followed with repeating from the second step above.

The time-out request signal may include a unique identifier code that allows the receiver unit 14 to determine which one of the two transmitter unit 12 is transmitting the desired time-out signal (e.g. Team A or Team B). In some embodiments, the identifier code is digital. In other embodiments, it is analog, for example by being represented by a modulation frequency.

In another embodiment of the transmitter method of operation, the second step may allow the desired time-out signal to be repetitively transmitted by the transmitter unit 12 through the third step as long as the coach keeps pressing on the time-out request button 26.

Now referring to FIGS. 1 and 3, the receiver unit 14 includes a receiver housing 40 in which is mounted an electronic circuit. The electronic circuit includes a receiver microprocessor 42 operatively coupled to an internal battery 20 or, alternatively, an external power source port 44 through a power interface circuit 46 and a manual power switch 22, a Society of Motion Picture and Television Engineers (SMPTE) interface port 48 through a video driver circuit 50, at least one radio-frequency (RF) antenna 30 through an antenna driver circuit 32, which together form a signal receiver, a loud speaker element 52 through a speaker driver circuit 54, Team A and Team B requested T-O visual indicators 56 and 58 through an requested T-O indicator driver circuit 60, and a receiver user interface 62.

Likewise the transmitter unit 12 described further above, the receiver microprocessor 42 is for example one of the latest generations of low power programmable microprocessor, micro-controller unit (MCU) or an equivalent instruction processing means that is provided with suitable processing power, memory and inputs/outputs (I/O's). However, in alternative embodiments, the receiver unit 13 perform its functions in any other suitable manner, for example by including suitable analog electronic components, digital logic gates, and Field Programmable Gate Arrays (FPGAs), for example.

The receiver microprocessor 42, or an appended memory element thereof, is where is stored a program element implementing receiver method of operation to be executed by the receiver microprocessor 42. The receiver method of operation will be described further below.

The internal battery 20, the external power source port 44, the power interface circuit 46 and the manual power switch 22 are for selectively powering On and Off the receiver unit 14, and more specifically the various electronic components and circuits thereof. The internal battery 20 may be a replaceable battery, or a permanent rechargeable battery.

Any commercially available and suitably rated AC to DC power adapter (not shown) may be used to provide DC power through the external power source port 44 in a conventional manner. Thus, the power interface circuit 46 may allow the external power source 64 to power the receiver unit 14, as well as simultaneously recharging the rechargeable battery if applicable.

The SMPTE interface port 48 is for communicating a compatible playback signal to a video recording system 49 that is actively recording the game event. The video recording system 49 is operative for playing back part of the game when receiving a playback signal. The playback signal is for example communicated using a digital video transmission standard published by the Society of Motion Picture and Television Engineers (SMPTE). The video driver circuit 50 is for converting selected information provided by the receiver microprocessor 42 to the required digital voltage signal of the SMPTE standard, for proper transmission over a coaxial video cable 66.

The selected information is for example the game time at which each desired time-out signal issued by the coach of each team has been received by the receiver unit 14. With such information, the video recording system 49 can broadcast a video replay of the recorded game in which the video is appended with the exact relative time at which a desired time-out signal has been issued such that conflicts between teams and delegate may be positively resolved without second guess.

Such conflict often arise during an often occurring delay between the exact moment in time a coach asks for a time-out and the exact moment in time a time-out official grants the requested time-out to the coach, where the opponent team takes an opportunity to recover the ball and score in the goal of the team that had asked for the time-out in the first place.

An object of the present invention is to substantially reduce the possibility of such conflicts, particularly during internationally recognized handball, basketball, water polo, or other sports tournaments where such conflicts are reputed to often degenerate into acute hostile situations.

The radio-frequency (RF) antennas 30 and antenna driver circuit 32 are for respectively receiving wirelessly transmitted desired time-out signals generated by any one or, simultaneously, by both transmitter units 12, and suitably converting the received signal or signals so as to be usable by the receiver microprocessor 42.

The speaker driver circuit 54 drives the loud speaker element 52 for emitting an audio signal in response to a suitable signal transmitted thereto and generated by the receiver microprocessor 42, either in response to a manual command by the time-out official, or to an automated command from the receiver method of operation. The loud speaker element 52 is typically sufficiently powerful for being heard through a noisy environment such as typically at a sport event in a large gymnasium with filled bleacher seating's. For example, the loud speaker element 52 may be represented one, or more than one, standard audio speaker, piezoelectric buzzer, power horn speaker, or the likes.

Visual indicator Team A requested T-O 56 and Team B requested T-O 58 are for indicating that a desired time-out request is received from a respective one of Team A or Team B. Team A requested T-O 56 and Team B requested T-O 58 for example each have a different color from one another, for helping the distinction between the two visual indicators from a distance. Furthermore, Team A requested T-O 56 and Team B requested T-O 58 may be preferably represented by incandescent lights (as illustrated in FIG. 1), stroboscopic lights, light emitting diodes (LEDs), or the likes, and their turning on or off is controlled by the receiver microprocessor 42.

The receiver user interface 62 includes a display driver circuit 70 operatively coupled to a game time display 72, a Team A display 74 and a Team B display 76. The game time display 72, the Team A display 74 and the Team B display 76 are each a time display having for example a double digit minutes and seconds format (e.g. mm:ss format), and may be represented, for example, by individual or grouped seven segments numerical L.E.D. displays, L.C.D. displays (Liquid Crystal Displays), or equivalent.

The game time display 72 is for displaying an incremental elapsing time, or chronometer, of the currently played game, which is typically in the range of 00:00 to a half time of 30:00 (thirty minutes) for the predetermined duration of half of a handball game. Other values in the range of 00:00 up to 99:99 are also possible for other types of athletic games between two teams. The game time display 72 is updated as the game progress by a game clock. The game clock may be implemented using the receiver microprocessor 42, or using an external game clock. In that latter case, the game time display 72 may be optionally omitted and the external game clock may have its own game time display.

Team A display 74 and Team B display 76 are each for individually displaying a respective time value during a currently played game, at which the respective coach of each team, e.g. of Team A and Team B, has requested a time-out to the time-out official using the transmitter unit 12 in his or her possession.

The receiver user interface 62 further includes a visual indicator driver circuit 34 operatively coupled to a plurality of visual indicators. Likewise the transmitter unit 12, these visual indicators may be preferably represented by low power L.E.D. indicator lights or equivalent. Each visual indicator represents a function of the receiver unit 14 as follow.

Visual indicators Team A T-O count 78A, 78B and 78C, and Team B T-O count 80A, 80B and 80*c* are each for individually indicating a time-out period that has been granted by the time-out official to each team respectively during the current game, including the one actively elapsing. The visual indicators Team A T-O count 78A, 786 and 78C, and Team B T-O count 80A, 80B and 80*c* therefore define Team A and Team B time-out counters 78 and 80 as the number of visual indicators that are lighted up indicates the number of time-outs already taken. In other embodiments, a numerical display unit is used to replace each of the Visual indicators Team A T-O count 78A, 78B and 78C, and Team B T-O count 80A, 80B and 80*c*. Also, although there are illustrated only three (3) individual time-out counts per teams, as is the rule in internationally recognized handball games, it is to be understood that the receiver unit 14 may be provided with fewer or more than three (3) individual time-out counts per teams to suit other types of athletic game between two teams.

In some embodiments, the receiver user interface 62 may further include a communication status indicator 36 and a battery status indicator 38, for respectively indicating to the time-out official that a wireless communication is actively received by the receiver unit 14 from one or both transmitter units 12, and that the battery of the receiver unit 14 has sufficient, or alternatively, insufficient power to properly operate the receiver unit 14. These visual indicators may be positioned, for example, on the side or rear of the receiver housing 40. Likewise the transmitter unit 12, these visual indicators may be represented by L.E.D. indicator lights or equivalent.

The receiver user interface 62 further includes a push button driver circuit 25 operatively coupled to a plurality of buttons. The push button driver circuit 25 is itself operatively coupled to the receiver microprocessor 42 for indicating to the latter when one or more of the buttons is pressed. For example, the buttons are momentary push button type switches or equivalent. Each button represents a function of the receiver unit 14 as follow.

Buttons Minutes+ 82, Minutes− 84, Seconds+ 86 and Seconds− 88 are for allowing a user to selectively adjust the minutes and seconds values respectively, that are displayed in the game time display 72, while the latter is in a game time stop mode. The game time stop mode will be described further below.

Button Siren 90 is for allowing a user to manually activate the loud speaker element 52 for audibly signaling a game related event or to draw attention.

Button Reset 92 is for allowing a user to manually reset to their respective default value all display and visual indicator means of the receiver unit 14, such as when starting a new game or a new half-time period. Turning Off and then back On the receiver unit 14 through the power switch 22 has the same effect.

Button Start-Stop 94 is for alternatively starting and stopping an internal timer function that operates time running mode that displays a running time in the format mm:ss on the game time display 72. In other words, the Button Start-Stop 94 controls manually the operation of the game clock.

The antenna driver circuit 32, visual indicator driver circuit 34, push button driver circuit 25, video driver circuit 50, speaker driver circuit 54, requested T-O indicator driver circuit 60 and display driver circuit 70 are operatively coupled to the receiver microprocessor 42 for exchanging electrical signals therewith so that information can be exchanged therewith to control operation of the receiver unit 14 as described hereinbelow.

In a similar fashion as the transmitter method of operation, the receiver method of operation may be generally represented by a plurality of conventional loop-type set of software program instructions that, additionally to initializing the receiver unit 14 on power up of the latter, enables the operations associated with the Minutes+ 82, Minutes− 84, Seconds+ 86, Seconds− 88, Siren 90, Reset 92 and Start-Stop 94 button means, as described above.

Figure 6:
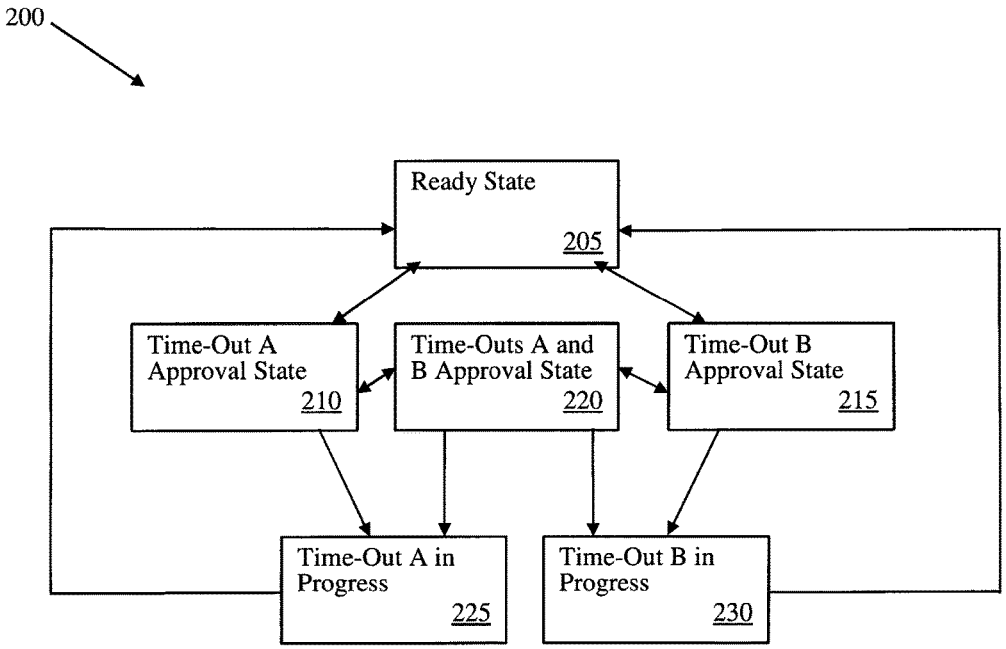
FIG. 6, in a flow chart, illustrates a state diagram for operation of the receiver unit of FIG. 3.

The receiver method of operation may further include the following loop-type set of software program instructions for enabling the following operation steps. Before describing the method of operation, it is useful to represent the receiver unit 14 as moving between various states shown in the state diagram 200 of FIG. 6. It should be noted that this state diagram 200 is given for exemplary purposes only and that alternative embodiments of the invention may operate according to other state representations. Also, the state diagram 200 does not imply that the receiver unit 14 must be programmed as a formal state machine. It is only used as a convenient representation of the operation of the receiver unit 14. For example, the state of the receiver unit may be represented by a register that keeps track of this state, or simply by a suitable program architecture in which subroutines are only called when relevant to the specific state.

The first state represented in the Ready State 205. In that state, no desired time-out signal has been received. When a desired time-out signal is received from either Team A or Team B, the receiver unit 14 moves respectively to the Time-Out A Approval State 210 or Time-Out B Approval State 215. If, before the time-out thus requested in not yet approved when a desired time-out signal is received from the other team, the receiver unit 14 is moved to the Time-Outs A and B Approval State 220. Typically, the game clock keeps on running in all the previously described states. If the receiver unit 14 is in the Time-Out A Approval State 210 or Time-Out B Approval State 215 and the time-out request is denied, the receiver unit 14 is returned to the Ready State 205. If the receiver unit 14 is in the Time-Outs A and B Approval State 220 and the time-out for Team A or Team B is denied, the receiver unit 14 is moved to the Time-Out B Approval State 215 and Time-Out A Approval State 210 respectively. Finally, if a time-out is approved for Team A or Team B, the receiver unit is moved to the Time-out A in Progress or Time-out B in Progress state 225 or 230 respectively. In the Time-out A in Progress and Time-out B in Progress States 225 and 230, the game clock is typically stopped. From the Time-out A in Progress or Time-out B in Progress state 225 or 230 respectively, the receiver unit 14 can be returned to the Ready State 205 once the time-out is completed.

Generally speaking a method according to the invention proceeds as follows. First, with the receiver unit 14 in the Ready State 205, the receiver unit 14 receives a desired time-out signal from one of the transmitter units 12, the desired time-out signal indicating that the game participant wishes to take one of the time-outs. Then, the receiver unit 14 is put in one of the Time-Out A or Time-Out B Approval State 210 and 215 and the receiver unit 14 indicates indicating to the game official through the receiver user interface 62 that the desired time-out signal has been received. Then, receiver user interface 62 receives from the game official one of an allow command and a deny command, wherein the allow and deny commands indicate respectively that the one of the time-outs is allowed or denied, the allow and deny commands being issued by the game official according to predetermined criteria dictated by rules according to which the game is played. When the allow command is received, the Team A and Team B time-out counter 78 and 80 corresponding to the team whose time-out request has been allowed is incremented, and, when the deny command is received, the receiver unit is returned to the Ready State 205 while keeping constant the Team A and Team B time-out counters 78 and 80. Once the time-out is finished, the receiver unit 14 typically returns to the Ready State 205.

Figure 7:
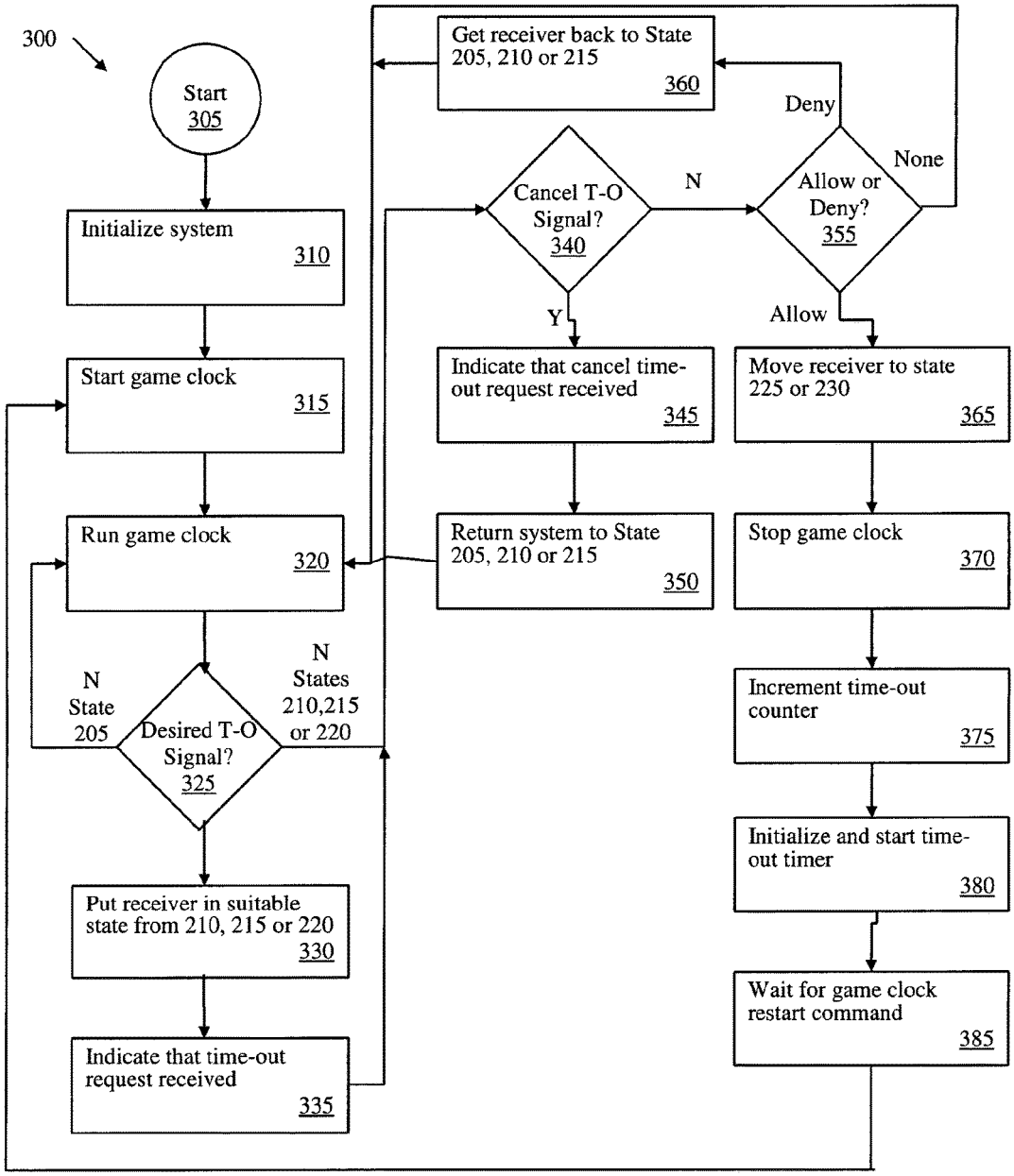
FIG. 7, in a flow chart, illustrates a method of operation of the receiver unit of FIG. 3.

As described hereinabove, many other functionalities may be implemented in the receiver unit 14, but the previous paragraph describes a simple embodiment of the invention that would be useful in its own. A more complex embodiment of the invention includes the receiver unit 14 that operates using the method 300 shown in FIG. 7. Many of the steps described hereinbelow are optional in some embodiments, especially for simplified systems.

The method 300 starts at step 305 and proceeds first with initialization of the system 10 at step 310. Initialization includes, among other things, putting the receiver unit 14 in the Ready State 205. Then, at step 315, the game clock, when present, is started when the game starts. At step 320, the game clock runs so that the game is timed. This step may be performed by counting down from a predetermined game or game segment, such as half-time, duration, or counting up from zero. Counting up is used, among other examples, in the game of soccer. Counting down is used, for example, for the game of water-polo.

Then, at step 325, the receiver microprocessor 42 checks if a desired time-out signal is received at the antenna 30 of the receiver unit 14. If no desired time-out signal has been received and the receiver unit is in the Ready State 205, the method loops back to step 320. If a desired time-out signal has been received, the method proceeds to step 330. The desired time-out signal indicating that the game participant wishes to take one of the time-outs. If no desired time-out signal is received, but one has been received recently so that the receiver unit is still in one of the Time-out A Approval State 210, Time-out B Approval State 215 and Time-outs A and B Approval State 220, the method goes to step 340.

Step 330, and the next step 335, are performed to ensure that the time-out request corresponding to the received desired time-out signal is signaled to the game official and processed. Thus, in step 330, the receiver unit 14 is transitioned to one of the Time-out A Approval State 210, Time-out B Approval State 215 and Time-outs A and B Approval State 220, depending on which transmitter unit 12 (from Team A or B) has issued the received desired time-out signal, and whether or not a desired time-out signal from the other team has been received previously and remains to be processed. These transitions are performed according to the state diagram 200. Then, at step 335, the receiver unit 14 indicates to the game official through the receiver user interface 62 that the desired time-out signal has been received. Typically, this is performed by the receiver microprocessor 42 which activates the speaker driver circuit 54 to drive the loud speaker element 52 for emitting an audio signal of a predetermined duration and by visually signaling the reception of the desired time-out request signal, although only visual or only audio signaling is within the scope of the invention. Visual signaling can be performed by turning on a light, such as the corresponding Team A requested T-O 56 or Team B requested T-O 58 visual indicators and/or by having the receiver microprocessor 42 copying the actual time displayed in the game time display 72 into a respective one of the Team A display 74 or Team B display 76 that corresponds to the team that has effectively requested the time-out. The method then proceeds to step 340.

Step 340 may be omitted in some embodiments. However, in embodiments in which the game participant may cancel a time-out request, either to correct an accidental request or when the game rules allow such cancellation, the transmitter unit 12 may transmit a cancel time-out signal similarly to the manner in which the desired time-out signals are transmitted. In some embodiments, the cancel time-out signal is identical to the desired time-out signal and its interpretation is made according to the state in which the receiver unit it. For example, with the receiver unit in one of the Time-out A Approval State 210, Time-out B Approval State 215 and Time-outs A and B Approval State 220, the receiver unit may receive a cancel time-out signal, similarly to the manner in which desired time-out signals are received. The cancel time-out signal indicates that the game participant no longer wishes to take one of the time-outs. If a cancel time-out signal is received, the method 300 goes to step 345. Otherwise, the method proceeds to step 355.

Step 345, and its subsequent step 350, process the cancel time-out signal. At step 345, the receiver unit 14 indicates to the game official through the receiver user interface 62 that the cancel time-out signal has been received. This indication may for example proceed by reversing any visual indication provided at step 335 and/or issuing an audio signal in the form of a desired time-out sound, using the loud speaker element 52, similarly to the manner in which audio signals are generated at step 335. The audio signal generated at steps 345 and 335 may differ in frequency, duration, or both, to allow distinction between them, or they may be identical. Then, at step 350, when the cancel time-out signal is received before the allow command (described in details hereinbelow) is received, the receiver unit 14 is returned to the Ready State 205, Time-Out A Approval State 210 or Time-Out B Approval State 215, depending on whether or not another time-out request is pending or not, while keeping constant the Team A and Team B time-out counters 78 and 80 and the method loops back to step 320.

Step 355 is performed to allow the game official to allow or deny a time-out requested. To indicate such allowance or denial, the game official my use the receiver user interface 62 to issue one of an allow command and a deny command. The allow and deny commands indicate respectively that one of the time-outs is allowed or denied. The allow and deny commands are issued by the game official according to predetermined criteria dictated by rules according to which the game is played. These commands are receives from the game official through the receiver user interface 62. They may be received through dedicated buttons. However, to reduce the number of buttons, the receiver unit may repurpose the already present Buttons Minutes+ 82, Minutes− 84, Seconds+ 86 and Seconds− 88 buttons. A button with an "up" arrow, used to increment minutes or seconds, may be used for allow commands, and a button with a "down" arrow, used to decrement minutes or seconds, may be used for deny command. Conveniently, due to the layout of the receiver user interface 62, the Buttons Minutes+ 82 and Minutes− 84 may be aligned with the Team A display 74 and used to receive allow and deny commands for Team A, and the Buttons Seconds+ 86 and Seconds− 88 may be aligned with the Team B display 76 and used to receive allow and deny commands for Team B. When an allow command is received, the method goes to step 365. When a deny command is received, the method goes to step 360. Otherwise, when none of the allow and deny commands are received, the method loops back to step 320.

Step 360 is performed after a deny command is received. In this step, the receiver unit 14 is returned to the Ready State 205, Time-Out A Approval State 210, or Time-Out B Approval State, depending on whether or not another time-out request is pending approval, while keeping constant the Team A and Team B time-out counters 78 and 80. Also, the visual indications turned on at step 335 are reversed to their pre-step 335 state. The method then loops back to step 320.

Step 365, and subsequent steps 370, 375, 380 and 385, are performed in sequence after an allow command is received. First, at step 365, the receiver unit 14 is moved to the suitable Time-out A in Progress or Time-out B in Progress State 225 or 230, according to the team whose time-out request has been allowed.

Then, at step 370, the game clock is stopped. This is either performed directly by the receiver microprocessor 42, when the game clock is integrated in the receiver unit 14, manually by the game official, or by automatically issuing, upon command by the receiver microprocessor 42, a game clock stop signal from the receiver unit 14 to an external game clock (not shown in the drawings), in which case, the game clock, in response to receiving the game clock stop signal, stops running. In some embodiments, the game clock may be returned to the exact time at which the game clock was when the desired time-out signal has been received. This may be performed manually, as detailed hereinabove, or automatically.

Then, at step 375 the Team A or Team B time-out counter 78 or 80 corresponding to the team requesting the time-out is incremented. This is performed for example by activating the next non-activated visual indicator among the corresponding one of Team A T-O count 78A, 78B and 78C, or Team B T-O count 80A, 80B and 80C. In some embodiments, at step 380, a time-out timer part of the came clock is initialized and starter automatically when the game clock stop signal is received. Alternatively, the time-out timer is part of the receiver unit 14, for example by re-purposing the 74 and 76 to do so, and the time-out timer is implemented by the receiver microprocessor 42. At step 385, the method waits until the time-out is elapsed, and until the game clock is restarted, either automatically once the time-out counter reaches zero, or upon a manual command from the game official, for example using the Button Start-Stop 94, at which point the method loops back to step 315.

There are many optional operations that may be performed in the method 300. For example, in embodiments of the invention in which the video recording system 49 is provided, the method may, for example during step 335, send a suitable time code for the time value displayed in the corresponding Team A requested T-O visual indicator 56 or Team B requested T-O visual indicator 58, through the SMPTE interface port 48. The time code represents then a playback signal. In response to having received the playback signal, the video recording system may replay, once or repeatedly, a short portion of the game around which the time-out request was made.

In some embodiments, the receiver unit 14 is operative for automatically denying the time-out at step 355 when at least one of the time-out rules dictates that the one of the time-outs should be denied. The method 300 then proceeds as if the game official had issued a deny command. This is performed by implementing one or more time-out rules in a program element running on the receiver microprocessor. For example, time-out requests may be required to be separated from each other by a predetermined time-out statutory delay, and the program element ensures that the predetermined time-out statutory delay by denying automatically any time-out request that occurs before the predetermined time-out statutory delay has elapsed. In other embodiments, time-out requests are automatically denied if the time-out counter is equal to a maximal number of time-outs allowed for a team. In some embodiments, the automatic denial of time-out requests is performed even before the game official is notified of a requested time-out.

In some embodiments, the receiver user interface 62 is operative for receiving manual increment and decrement commands from the game official and the receiver unit 14 is operative for increasing by one or decreasing by one the Team A and Team B time-out counters 78 and 80 in response to receiving respectively the manual increment and decrement commands. This may be performed for example once again by re-purposing the already present Buttons Minutes+ 82, Minutes− 84, Seconds+ 86 and Seconds− 88 buttons. The receiver microprocessor 42 may for example be programmed to interpret each push of one of the Buttons Minutes+ 82, Minutes− 84, Seconds+ 86 and Seconds− 88 buttons as instruction to respectively increment the time-out counter for Team A, decrement the time-out counter for Team A, increment the time-out counter for Team B and decrement the time-out counter for Team B when the receiver unit 14 is in the Ready State 205 and the game clock is running.

Figure 4:
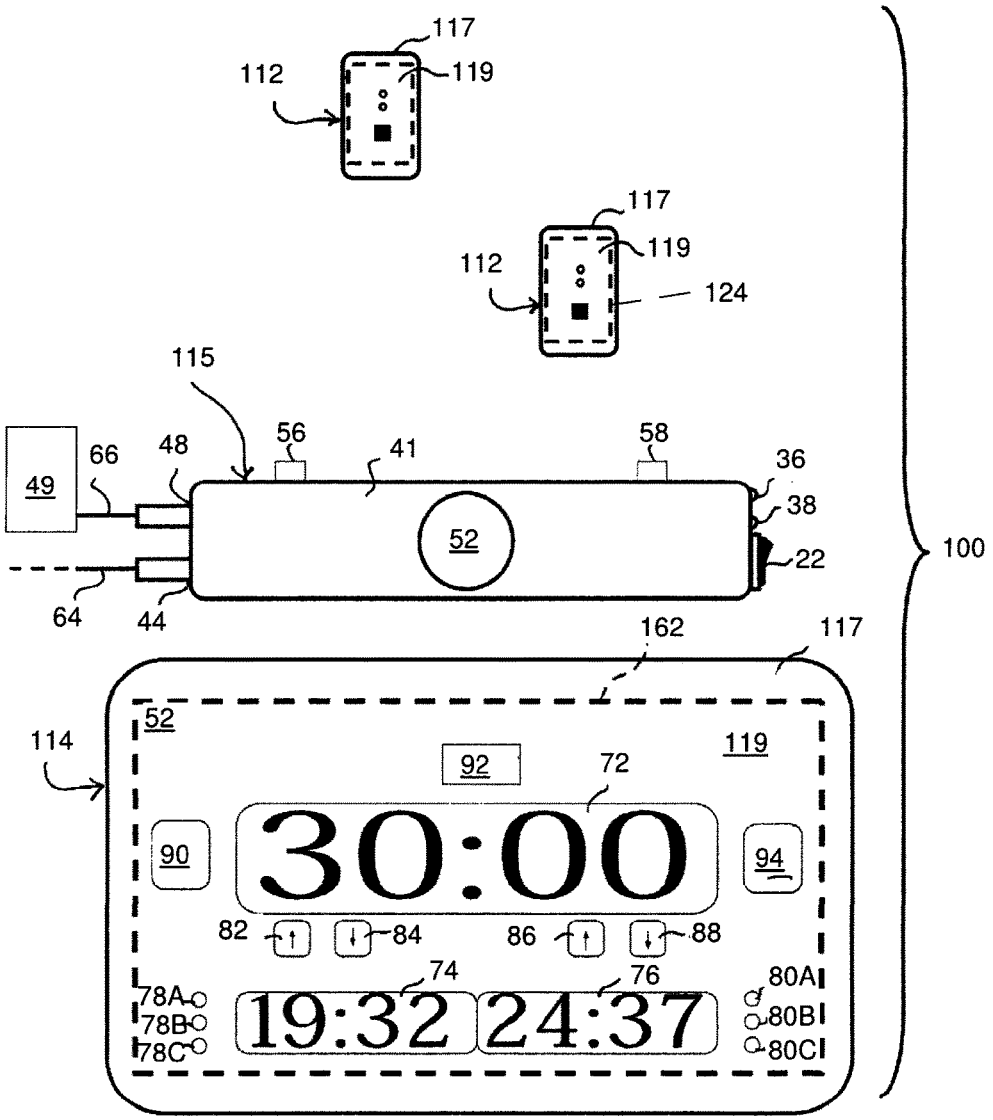
FIG. 4, in a front plan view, illustrates an alternate embodiment of a game time-outs management system, according to the present invention.
Figure 5:
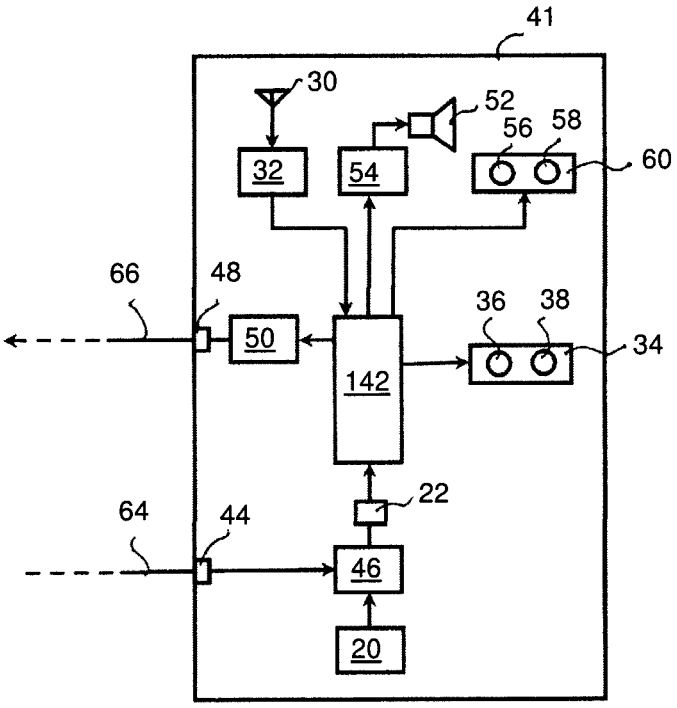
FIG. 5, in a schematic representation, illustrates an intermediate device part of the system of FIG. 4.

FIGS. 4 and 5 illustrate various aspects, according to the present invention, of an alternate embodiment of a game time-outs managing system 100 and method, which comprises a pair of transmitter units 112, a receiver unit 114, and an intermediate device 115.

In the presently described embodiment, the transmitter unit 12 is represented by a commercially available portable device 117 such as a smart phone or a tablet having a touchscreen 119, wireless capabilities, and is for example running one of the popular operating systems (OS) by Apple™, Google Android™ or Microsoft™.

The transmitter user interface 124 substantially reproduces graphically on the touchscreen 119 of the portable device 117 the transmitter user interface 24 of the first embodiment.

Furthermore, the transmitter unit 112 executes a transmitter method of operation that is functionally substantially similar to the transmitter method of operation of the first embodiment. Furthermore, the presently described transmitter method of operation may be preferably represented by a downloadable application that is stored in the memory of the portable device.

Thus, a desired time-out signal issued by one or both teams using a respective one of the transmitter units 112 may be wirelessly transmitted through a Wi-Fi based network available on the site of the game event, to the receiver unit 114 using any suitable communication protocol such as, for example, a well-known peer-to-peer (P2P) communication protocol, or the like.

In a similar fashion, the receiver unit 114 is represented by a commercially available portable device 117 such as a smart phone or a tablet having a touchscreen, wireless capabilities, and running for example one of the popular operating systems (OS) by Apple™, Google Android™ or Microsoft™.

The receiver method of operation of the present embodiment may also be represented by a downloadable application and is functionally substantially similar to the receiver method of operation of the first embodiment.

The receiver user interface 162 substantially reproduces graphically on the touchscreen 119 of the portable device 117, the receiver user interface 62 of the first embodiment.

The main differences between the presently described embodiment of the receiver unit 114, relative to the first embodiment described further above, reside in that the hardware elements of the first embodiment that are not natively supported by a commercially available portable device 117, such as the loud speaker element 52, the visual indicator means Team A requested T-O 56 and Team B requested T-O 58, and the SMPTE interface port 48, are integrated in the intermediate device 115, as best illustrated in FIG. 1.

Now referring to FIG. 5, the intermediate device 115 comprises an intermediate device housing 41 in which is mounted an electronic circuit. The electronic circuit includes an intermediate device microprocessor 142 operatively coupled to an internal battery 20 or, alternatively, an external power source port 44, such as a micro-USB communication link and power port, through a power interface circuit 46 and a manual power switch 22, an SMPTE interface port 48 through a video driver circuit 50, at least one Bluetooth® based radio-frequency (RF) antenna 30 through an antenna driver circuit 32, at least one loud speaker element 52 through a speaker driver circuit 54, and a Team A and a Team B requested T-O visual indicator 56 and 58 through a requested T-O indicator driver circuit 60.

Each components of the intermediate device 115 listed above may be substantially similar to the corresponding component of the first embodiment, or equivalent components thereof.

Likewise the transmitter unit 12 and receiver unit 14 of the first embodiment, the intermediate device 115 may further include suitable battery and communication status LEDs 36 and 38 through a visual indicator driver circuit 34.

The intermediate device microprocessor 142 executes an intermediate device method of operation that, after power up and initialization, essentially continually transfers the commands of the receiver microprocessor of the receiver unit 114, to the components of the intermediate device 115 through a Bluetooth wireless connection or the micro-USB communication link established there between.

As would be obvious to someone familiar with Bluetooth devices, the intermediate device method of operation may be downloaded and periodically updated using the receiver unit 114 through a Bluetooth wireless connection or the micro-USB communication link thereof.

In some embodiments of the portable device based embodiment of the present invention, as described above, the transmitter unit method of operation and the receiver unit method of operation may each further include a suitable user interface parameter menus. These user interface parameter menus may allow a user to adjust default parameters such as, for example, the number of periods in a game, a default period duration, the maximum number of time-out requests per team, the default duration of a time-out, trigger events and sound tones applicable to the loud speaker element, and the likes.

In another embodiment, as would be familiar to someone versed in the art of multimedia devices and communications, the graphical representation of the receiver user interface 162 on the touchscreen of the receiver unit 114 of the previously described embodiment may be duplicated wirelessly through a communication network to additional media display means such as auxiliary display monitors, a giant screen on the game court, television networks, and the likes using, for example, a live video streaming protocol. Alternatively or concurrently, a duplicate of the receiver user interface 162 may as well be transmitted using a Bluetooth wireless protocol, or a USB link, to the intermediate device 115, such that it is, in turn, transmitted through the standard SMPTE interface port 48.

In yet another alternate embodiment according to the present invention, the game time-outs managing system and method only comprises the transmitter unit method of operation, the receiver unit method of operation, the intermediate device 115 and the intermediate device method of operation, as described above, that are used in cooperative relation with commercially available portable devices, again, as described above, but these form no part of the invention. The present low budget embodiment may particularly suit low level or private game events.

In yet other alternative embodiments, a low-cost version of the receiver unit 14 may be manufactured by omitting the game time display 72, Team A display 74 and Team B display 76 and associated buttons. This device is then used in conjunction with a conventional game management system that includes a game clock, for the sole purpose of managing time-outs. In those embodiments, it is advantageous to have push-buttons that are dedicated to allowing and denying time-out requests.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A system for managing time-outs in a game in which a game participant requests said time-outs and a game official selectively deny or allow said time-outs depending on predetermined game rules, said system comprising:

a transmitter unit usable by said game participant, said transmitter unit including a transmitter user interface and a signal emitter; and a receiver unit usable by said game official, said receiver unit having a receiver user interface and a signal receiver, said receiver user interface having a time-out counter, said receiver unit being movable between a ready state and a time-out approval state;

wherein said transmitter unit is operative for receiving from said game participant through said transmitter user interface a time-out command indicating that one of said time-outs is desired and consequently sending a desired time-out signal to said receiver unit with said signal emitter, said desired time-out signal indicating that said game participant wishes to take said one of said time-outs;

wherein, when in said ready state, said receiver unit is operative for receiving said desired time-out signal at said signal receiver, consequently moving said receiver unit to said time-out approval state and indicating to said game official through said receiver user interface that said desired time-out signal has been received, said receiver unit being further operative, when in said time-out approval state, for receiving from said game official through said receiver user interface one of an allow command and a deny command, said allow and deny commands indicating respectively that said one of said time-outs is allowed or denied, said allow and deny commands being issued by said game official according to predetermined criteria dictated by said predetermined game rules; and wherein, when said allow command is received, said time-out counter is incremented, and, when said deny command is received, said receiver unit is returned to said ready state while keeping constant said time-out counter.

2. The system as defined in claim 1, wherein said game has a predetermined duration, said system further comprising a game clock, said receiver unit being operatively coupled to said game clock for stopping said game clock when said allow command is received and letting said game clock run when said deny command is received.

3. The system as defined in claim 2, wherein said game clock includes a time-out timer, said game clock being operative for starting said time-out timer automatically when said game clock is stopped.

4. The system as defined in claim 1, wherein said transmitter unit is operative for receiving from said game participant through said transmitter user interface a cancel time-out command indicating that said game participant no longer wishes to take said one of said time-outs and consequently sending a cancel time-out signal to said receiver unit with said signal emitter; and wherein said receiver unit is operative for receiving at said signal receiver said cancel time-out signal, consequently indicating to said game official through said receiver user interface that said cancel time-out signal has been received, and when said cancel time-out signal is received before said allow command is received, returning said receiver unit to said ready state while keeping constant said time-out counter.

5. The system as defined in claim 1, further comprising a video recording system usable to record said game, said video recording system being operative for playing back part of said game when receiving a playback signal, said receiver unit being operative for, in response to receiving said desired time-out signal, issuing said playback signal from said receiver unit to said video recording system so that said game can be played back around a moment at which said desired time-out signal has been received.

6. The system as defined in claim 1, wherein said receiver user interface is operative for receiving manual increment and decrement commands from said game official and said receiver unit is operative for increasing by one or decreasing by one said time-out counter in response to receiving respectively said manual increment and decrement commands.

7. The system as defined in claim 1, wherein said receiver user interface includes a visual indicator that is activated when said receiver unit is moved to said time-out approval state.

8. The system as defined in claim 1, wherein said receiver user interface includes a sound indicator that is activated when said receiver unit is moved to said time-out approval state.

9. The system as defined in claim 1, wherein said predetermined game rules include time-out rules determining when said one of said time-outs can be allowed, said receiver unit being operative for automatically denying said one of said time-outs and returning said receiver unit to said ready state when at least one of said time-out rules dictates that said one of said time-outs should be denied.

10. The system as defined in claim 9, wherein said at least one of said time-out rules dictates a maximal number of time-outs that can be requested during said game, said receiver unit being operative for comparing said time-out counter to said maximal number of time-outs when said desired time-out signal is received and automatically denying said time-out when said time-out counter and said maximal number of time-outs are equal.

11. The system as defined in claim 1, wherein an other game participant also requests said time-outs, said system further comprising an other transmitter unit usable by said other game participant, said other transmitter unit including an other transmitter user interface and an other signal emitter, wherein said receiver user interface has an other time-out counter, said receiver unit being also movable to an other time-out approval state;

said other transmitter unit is operative for receiving from said other game participant through said other transmitter user interface an other time-out command indicating that an other one of said time-outs is desired and consequently sending an other desired time-out signal to said receiver unit with said other signal emitter, said other desired time-out signal indicating that said other game participant wishes to take said other one of said time-outs;

wherein, when in said ready state, said receiver unit is operative for receiving said other desired time-out signal at said signal receiver, consequently moving said receiver unit to said other time-out approval state and indicating to said game official through said receiver user interface that said other desired time-out signal has been received, said receiver unit being further operative, when in said other time-out approval state, for receiving from said game official through said receiver user interface one of an other allow command and an other deny command, said other allow and deny commands indicating respectively that said other one of said time-outs is allowed or denied, said other allow and deny commands being issued by said game official according to said predetermined criteria; and wherein, when said other allow command is received, said other time-out counter is incremented, and, when said other deny command is received, said receiver unit is returned to said ready state while keeping constant said other time-out counter.

* * * * *